US006168288B1

(12) United States Patent
St. Claire

(10) Patent No.: US 6,168,288 B1
(45) Date of Patent: Jan. 2, 2001

(54) FLASHLIGHT WITH LIGHT EMITTING DIODES

(75) Inventor: Christian P. St. Claire, Petaluma, CA (US)

(73) Assignee: Tektite Industries West LLC, Petaluma, CA (US)

( * ) Notice: Under 35 U.S.C. 154(b), the term of this patent shall be extended for 0 days.

(21) Appl. No.: 09/368,937

(22) Filed: Aug. 5, 1999

(51) Int. Cl.[7] ..... F21L 4/02
(52) U.S. Cl. ..... 362/184; 362/800; 362/208
(58) Field of Search ..... 365/205, 204, 365/800; 313/512, 632, 113

(56) References Cited

U.S. PATENT DOCUMENTS

| | | | | |
|---|---|---|---|---|
| 4,800,469 | * | 1/1989 | Leon | 362/473 |
| 4,963,798 | * | 10/1990 | McDermott | 315/312 |
| 5,865,524 | * | 2/1999 | Campman | 362/102 |
| 6,019,482 | * | 2/2000 | Everett | 362/184 |

* cited by examiner

*Primary Examiner*—Sandra O'Shea
*Assistant Examiner*—Hargobind S. Sawhney
(74) *Attorney, Agent, or Firm*—Donald S. Cohen

(57) ABSTRACT

A battery operated flashlight having a light emitting diode (LED) as its light source. At least one LED is mounted on a plate of an insulating material having a pair of contacts on a surface thereof. Each of the LED's has a pair of terminals with one terminal being electrically connected to one contact on the plate and the other terminal being electrically connected to the other contact on the plate. The plate is mounted in the open end of a housing of the flashlight which also contains at least one battery and a contact strip extending from the open end of the housing to the closed end of the housing where it contacts a terminal of the battery. A cylindrical spacer of an insulating material is within the housing and extends between the plate and the open end of the housing. A cup shaped cap is threaded onto the open end of the housing. When the cap is threaded onto the housing it is adapted to contact the spacer and press it against the plate. This presses the plate against the contact strip and a terminal of the battery so as to electrically connected the LED across the battery and turn on the LED. When the cap is threaded in a direction off of the housing the plate is allowed to move away from the contact strip and the battery so as to turn off the LED.

13 Claims, 2 Drawing Sheets

FLASHLIGHT WITH LIGHT EMITTING DIODES

FIELD OF THE INVENTION

The present invention relates to a flashlight having at least one light emitting diode (LED) as its light source, and, more particularly, to a structure for mounting LEDs in a flashlight.

BACKGROUND OF THE INVENTION

A flashlight is, in general, a housing containing one or more batteries, a light source, and means for connecting and disconnecting the light source and the batteries to turn the flashlight on and off. Heretofore, the light source for a flashlight has been a small filament bulb. Generally a reflector is mounted behind the bulb to direct the light from the bulb outwardly from the flashlight. A problem with the use of a filament bulb is that it can bum out so that the bulb has a limited lifetime. Also, the filament bulb uses enough current that the batteries will also have a limited lifetime. LEDs have been a well known source of light. They are much smaller than a filament light bulb and have a longer lifetime. In addition, LEDs require less current so that the batteries used to operate LEDs have a longer lifetime. However, LEDs cannot be merely substituted for a filament light bulb in a flashlight because of the manner in which the filament bulb is generally mounted in the flashlight.

SUMMARY OF THE INVENTION

A flashlight includes a tubular housing having a closed end and an open end. At least one battery is in the housing. A substantially flat plate of an insulating material is mounted across the housing adjacent the open end thereof. The plate has a pair of opposed surfaces and a pair of spaced conductors are on the surface of the plate which faces away from the open end of the housing. At least one light emitting diode having a pair of terminals is mounted on the surface of the plate which faces the open end of the housing with the terminals being electrically connected to separate ones of the conductors on the plate. A cap is mounted on the open end of the housing and across the light emitting diode. Means is provided to selectively electrically connect and disconnect the light emitting diode and the battery.

DETAILED DESCRIPTION OF PREFERRED EMBODIMENT

Figure 1:
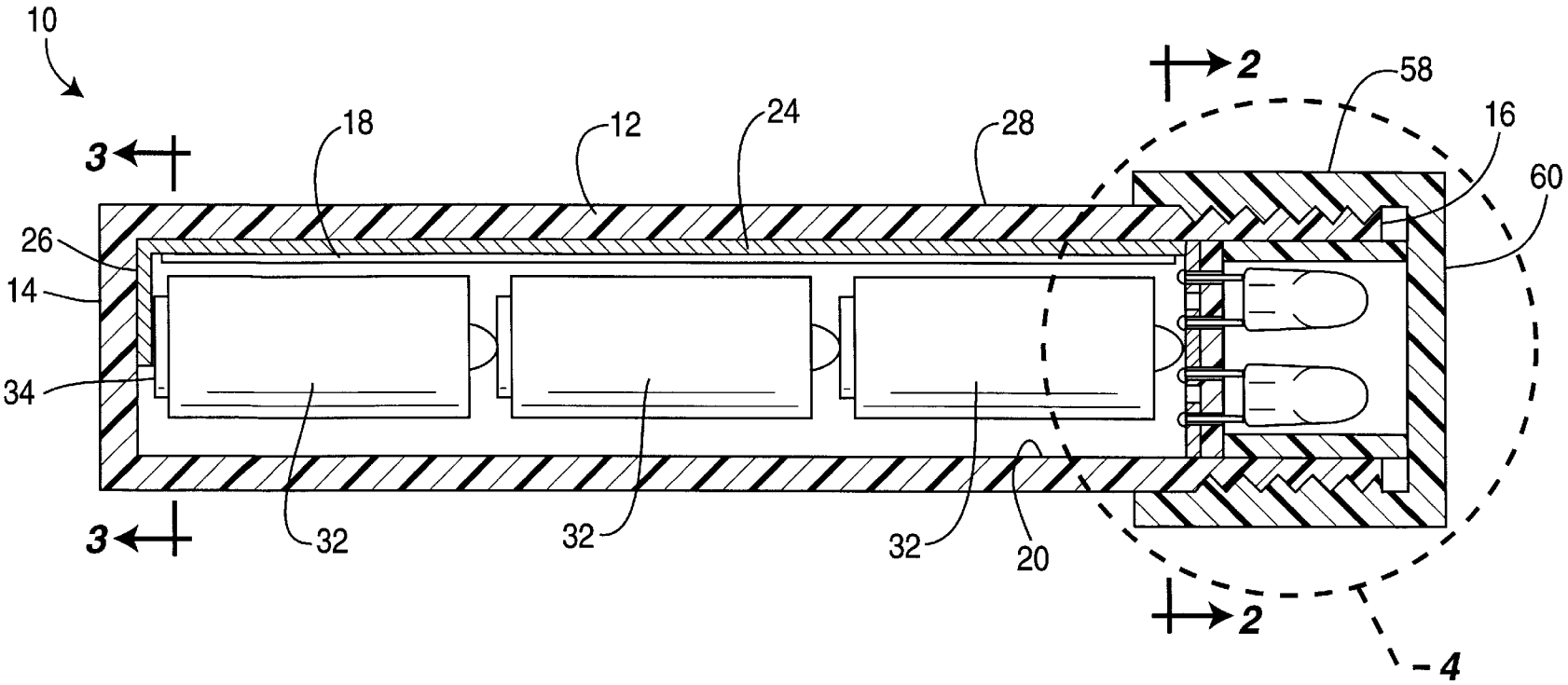
FIG. 1 is a longitudinal sectional view of the flashlight of the present invention.
Figure 3:
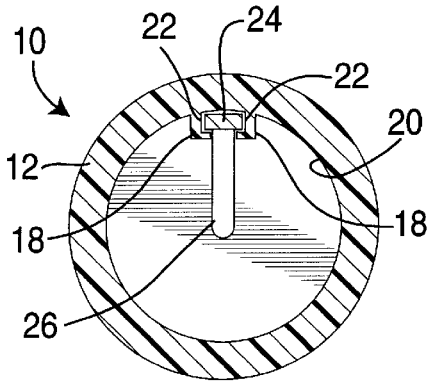
FIG. 3 is a sectional view taken along line 3—3 of FIG. 1 with the batteries removed.
Figure 4:
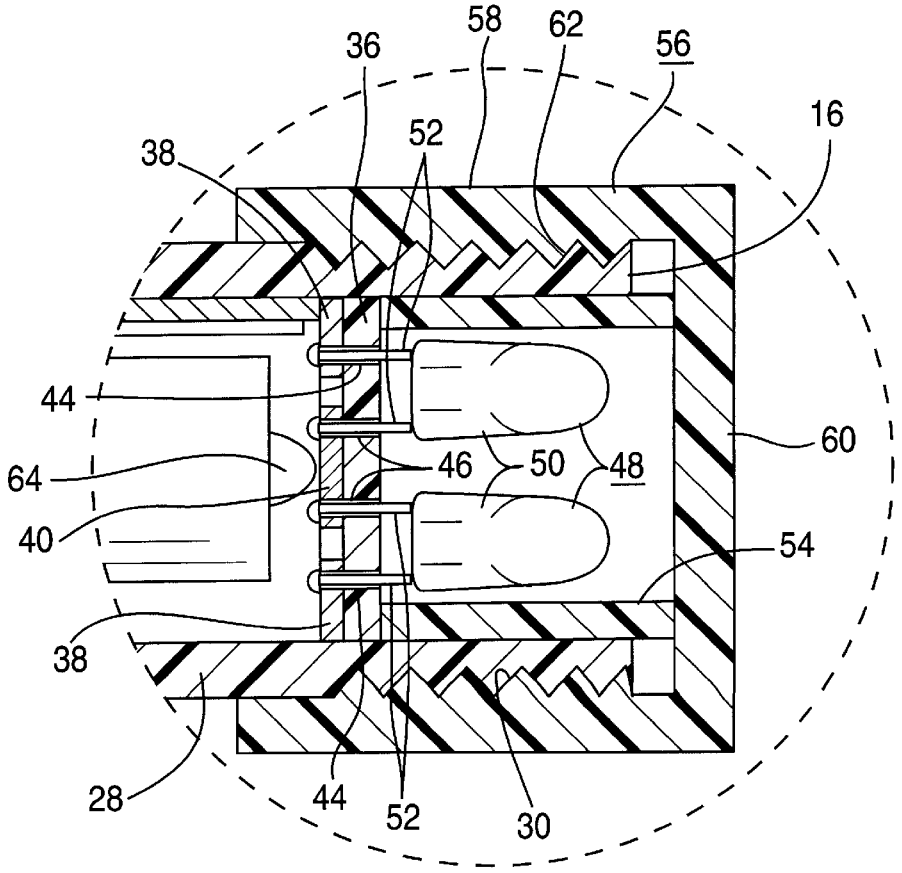
FIG. 4 is an enlarged view of the circled portion of FIG. 1.

Referring initially to FIG. 1 of the drawings, a form of the flashlight of the present invention is generally designated as 10. Flashlight 10 comprises an elongated tubular housing 12, preferably of a plastic. The housing 12 has a closed end 14 and an open end 16. As shown in FIG. 3, a pair of spaced ribs 18 extend inwardly of the housing 12 from the inner surface 20 of the housing 12. The ribs 18 extend from the closed end 14 of the housing 12 to a point spaced from the open end 16 of the housing 12. Each of the ribs 18 has a slot 22 in its surface which faces the other rib 18. The slots 22 extend the full length of the ribs 18. A metal contact strip 24 fits in the slots 22 and extends between the ribs 18. As shown in FIG. 1, the contact strip 24 extends the full length of the ribs 18 to the closed end 14 of the housing 12. At the closed end 14 of the housing 12, a contact 26 extends from the end of the contact strip 24 radially across the closed end 14 to substantially the center of the closed end 14. The outer surface 28 of the housing 12 has a thread therein at the open end 16 of the housing 12.

Batteries 32 are in the housing 12 and are arranged in series relation. Although there are shown three batteries 32 in the housing 12, any number of the batteries 32 can be used depending on the voltage required for the operation of the flashlight. The battery 32 at the closed end 14 of the housing 12 has a terminal 34 which engages the contact 26 at the closed end 14 of the housing 12.

Figure 2:
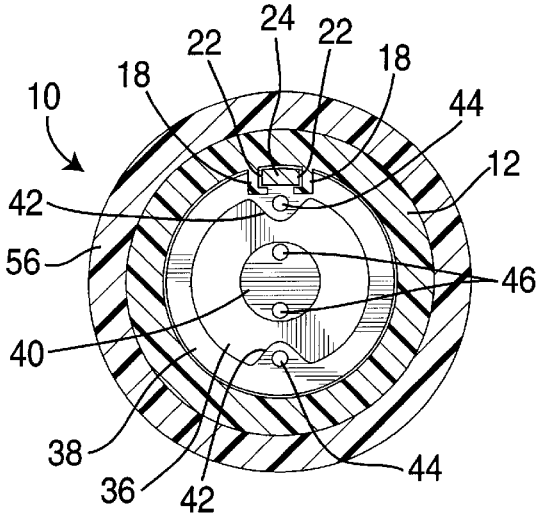
FIG. 2 is a sectional view taken along line 2—2 of FIG. 1.

A flat circular plate 36 of an insulating material, such as a plastic, is mounted in the housing 12 adjacent but spaced slightly from the open end 16 of the housing 12. On the surface of the plate 36 facing the batteries 32 are a pair of contact areas 38 and 40, each of a film of a conductive metal, such as copper or aluminum. The outer contact area 38 is in the form of an annulus which extends around the peripheral edge of the plate 36. The inner contact area 40 is in the form of a circle which is at the center of the surface of the plate 36 and is spaced from the outer contact area 38. As shown in FIG. 2, the outer contact area 38 has a plurality of spaced tabs 42 extending radially inwardly from its inner edge toward the inner contact area 40. However, the tabs 42 are spaced from the inner contact area 40. A plurality of holes 44 extend through the plate 36 with each of the holes 44 extending to a separate tab 42. A plurality of holes 46 extend through the plate 36 to the center contact area 40.

Light emitting diodes (LEDs) 48 are mounted on the plate 36 on the side of the plate 36 facing the open end 16 of the housing 12. Although there is shown two LEDs 48 mounted on the plate 26, any desired number of the LEDs can be used. Each of the LEDs 48 includes a casing 50 of a light transparent material, such as a glass, having therein a light emitting semiconductor diode, not shown. A pair of terminals 52 project from the casing 50 of each of the LEDs 48. Within the casing 50, the terminals 52 are connected to opposite sides of the light emitting semiconductor diode. One terminal 52 of each LED 48 extends through a hole 44 in the plate to a tab 42 of the outer contact area 38. The other terminal 52 of each LED 48 extends through a hole 46 in the plate 36 to the inner contact area 40. The terminals 52 are electrically and mechanically connected to the contact areas 38 and 40 by a suitable solder 54. Although any suitable LED which emits light at the desired wavelength can be used, a suitable LED is one that emit white light, such as the Nichia 5 mm white LED sold by the Nichia American Corporation of Lancaster, Pa.

A cylindrical spacer ring 54 of a plastic material is within the housing 12 at the open end 16 thereof. The outer diameter of the spacer ring 54 is substantially the same as the diameter of the inner surface 20 of the housing 12 so that the spacer ring 54 can slide within the housing 12. The inner diameter of the spacer ring 54 is such that it is spaced from the LEDs 48. The spacer ring 54 is of a length that it extends from the plate 36 beyond the open end 16 of the housing and beyond the ends of the LEDs 48. A cup shaped cap 56 is mounted on the open end 16 of the housing 12. The cap 56 has a cylindrical wall 58 and an end wall 60. The cylindrical wall 58 of the cap 56 has an inner diameter substantially the same as the diameter of the outer surface 28 of the housing 12, and has a thread 62 in its inner surface. Thus, the capa 56 can be threaded onto the open end 16 of the housing 12 with the end wall 60 of the cap 56 extending across the open end 16 of the housing 12. At least the end wall 60 of the cap 56 is of a light transparent material to allow the light from the LEDs to pass therethrough.

In the operation of the flashlight 10, the cap 56 is threaded onto the housing 12 to move the end wall 60 of the cap 56 toward the open end 16 of the housing 12. However, as the cap 56 is threaded onto the housing 12, the end wall 60 of the cap 56 will contact the spacer ring 54 and press the spacer ring 54 against the plate 36. This moves the plate 36 toward the closed end 14 of the housing 12 until the outer contact area 38 on the plate 36 contacts the end of the contact strip 24, and the inner contact area 40 of the plate 36 contacts a terminal 64 of a battery 32. This also presses the batteries 32 together with the terminal 34 of the battery 32 at the closed end 14 of the housing being brought into engagement with the contact 26 on the end of the contact strip 24. This closes the electrical circuit between the batteries 32 and the LEDs 48 to cause the LEDs to light up. Thus, the cap 56 can be threaded onto the housing 12 so as to act as a switch to turn the flashlight 10 on. When the cap 56 is threaded on the housing 12 in the opposite direction so as to move the end wall 60 of the cap 56 away from the spacer ring 54, the plate 36 is allowed to move away from the contact strip 24 and the terminal 64 of the adjacent battery 32 and thereby break the electrical circuit between the batteries 32 and the LEDs 48. This causes the LEDs to be turned off. Thus, the cap 56 serves as a switch to turn the flashlight off and on.

Thus, there is provided by the present invention a flashlight having LEDs as the light source of the flashlight. The LEDs are mounted on a plate having a pair of spaced conductors on one surface thereof. Each of the LEDs has a pair of terminals and the LEDs are mounted on the plate with one terminal of each LED extending through a hole in the plate to one of the conductors and the other terminal of each LED extending through a hole in the plate to the other conductor. The terminals are electrically and mechanically secured to the conductors. The plate is mounted in a housing of the flashlight which also contains batteries. A cap is threaded on the housing and is adapted to move the plate so as to selectively connect and disconnect the contacts on the plate across the batteries and thereby turn the flashlight on and off.

What is claimed is:

1. A flashlight comprising:

a tubular housing having a closed end and an open end;

at least one battery in the housing having terminals at opposite ends;

a substantially flat plate of an insulating material having opposed surfaces, said plate extending across the housing between the battery and the open end of the housing;

spaced conductors on the surface of the plate facing the battery, each of the conductors being a film of a conducting material with a first conductor extending in an annular path around the peripheral edge of the surface of the plate and a second conductor being within and spaced from the first conductor;

at least one light emitting diode having a pair of terminals, said light emitting diode being mounted on the surface of the plate facing the open end of the housing with each of the terminals being electrically connected to a separate one of the conductors on the plate;

a cap mounted on the open end of the housing and extending across the light emitting diode; and means for selectively electrically connecting and disconnecting the light emitting diode and the battery to turn the flashlight on and off.

2. The flashlight of claim 1 in which the first conductor has at least one tab extending radially inwardly from the inner edge of the first conductor.

3. The flashlight of claim 2 wherein the plate has a pair of holes therethrough with one of the holes extending through the tab on the first conductor and the other hole extending through the second conductor, and each of the terminals of the light emitting diode extends through a separate hole and is electrically connected to a respective conductor.

4. The flashlight of claim 3 further comprising a contact strip of a conductive metal mounted on and extending longitudinally along the inner surface of the housing between the closed end of the housing and the plate, and a contact extending from the end of the contact strip at the closed end of the housing across the closed end of the housing, said contact being engagable by a terminal of a battery in the housing and the end of the contact strip adjacent the plate being engagable by the first conductor on the plate.

5. The flashlight of claim 4 further comprising a cylindrical spacer ring of an insulating material within the housing between the plate and the open end of the housing and extending around the light emitting diode, said spacer being engagable by the cap to push the spacer ring against the plate so as to move the plate to bring the first conductor into contact with the contact strip and the second conductor into contact with a terminal of the battery.

6. The flashlight of claim 5 in which the cap is cup shaped having a cylindrical wall extending around the outer surface of the housing at the open end of the housing and an end wall extending across the open end of the housing, at least the end wall of the cap being of a transparent material to allow light to pass therethrough.

7. The flashlight of claim 6 in which the outer surface of the housing has a thread therein adjacent the open end of the housing and the cylindrical wall of the cap has a corresponding thread in its inner surface to allow the cap to be threaded onto the housing.

8. The flashlight of claim 7 in which the spacer ring is of a length so as to project beyond the open end of the housing so that it can be engaged by the end wall of the cap when the cap is threaded on the housing.

9. The flashlight of claim 3 further comprising a pair of light emitting diodes mounted on the plate with each light emitting diode having a pair of terminals with one terminal of each light emitting diode being electrically connect to the first conductor on the plate and the other terminal of each of the light emitting diodes being electrically connected to the second conductor on the plate.

10. The flashlight of claim 9 wherein the first conductor on the plate has a pair of spaced tabs extending radially inwardly therefrom, two pairs of holes extend through the plate with one hole of each pair extending to a separate one of the tabs and the other hole of each pair extending to the second conductor.

11. The flashlight of claim 10 wherein one terminal of each of the light emitting diodes extends through a separate hole extending to a tab, and the other terminal of each of the light emitting diodes extends through a separate hole extending to the second conductor, and all of the terminals are electrically and mechanically secured to their respective conductors.

12. The flashlight of claim 11 in which each of the light emitting diodes emits a white light.

13. The flashlight of claim 12 in which there are three batteries in the housing.

* * * * *